US009608363B2

(12) United States Patent
Greene

(10) Patent No.: US 9,608,363 B2
(45) Date of Patent: Mar. 28, 2017

(54) SEALING INSERT FOR ELECTRICAL CONNECTORS

(71) Applicant: MAGNA POWERTRAIN, INC., Concord, Ontario (CA)

(72) Inventor: Darrell F. Greene, Bradford (CA)

(73) Assignee: MAGNA POWERTRAIN, INC., Concord (CA)

( * ) Notice: Subject to any disclaimer, the term of this patent is extended or adjusted under 35 U.S.C. 154(b) by 0 days.

(21) Appl. No.: 14/807,910

(22) Filed: Jul. 24, 2015

(65) Prior Publication Data

US 2017/0025784 A1 Jan. 26, 2017

(51) Int. Cl.

| | |
|---|---|
| ***H01R 13/52*** | (2006.01) |
| ***H01R 43/00*** | (2006.01) |
| ***H01R 43/20*** | (2006.01) |

(52) U.S. Cl.

CPC ..... *H01R 13/521* (2013.01); *H01R 43/005* (2013.01); *H01R 43/20* (2013.01)

(58) Field of Classification Search

CPC . H01R 13/521; H01R 13/5219; H01R 13/523

USPC ..... 439/752, 271, 273, 587; 174/50.52

See application file for complete search history.

(56) References Cited

U.S. PATENT DOCUMENTS

| | | | | |
|---|---|---|---|---|
| 5,483,743 | A | 1/1996 | Armogan et al. | |
| 5,518,427 | A | 5/1996 | Kan et al. | |
| 5,535,512 | A | 7/1996 | Armogan | |
| 5,743,756 | A | 4/1998 | Hasz et al. | |
| 6,632,104 | B2 * | 10/2003 | Quadir | H01B 17/306 439/587 |
| 7,578,708 | B2 | 8/2009 | Hachadorian | |
| 7,841,912 | B2 | 11/2010 | Hachadorian | |
| 8,378,239 | B2 | 2/2013 | Lakner et al. | |
| 8,475,204 | B2 | 7/2013 | Blasick et al. | |
| 8,614,400 | B2 * | 12/2013 | Aldrich | H02G 3/083 174/650 |
| 2010/0255723 | A1 | 10/2010 | Didra et al. | |

* cited by examiner

*Primary Examiner* — Vanessa Girardi

(74) *Attorney, Agent, or Firm* — Dickinson Wright PLLC

(57) ABSTRACT

Disclosed is a method and structure for sealing an electrical connector. The structure includes a sealing insert for insertion into the housing of an electrical connector. The sealing insert has a flared lip spaced from and extending above a base and the flared lip has a diameter that is larger than a diameter of the base. The sealing insert further includes a retention feature and at least one electrical pin guide. The sealing insert is inserted into the housing of an electrical connector after applying a form in place sealant inside the housing. The flared lip forms a seal against an inner wall of the housing and the retention feature of the sealing insert engages a retention feature inside the housing thereby locking the sealing insert into the housing and forcing the sealant into a sealant gap formed between the housing and the sealing insert thereby sealing the electrical connector.

17 Claims, 11 Drawing Sheets

SEALING INSERT FOR ELECTRICAL CONNECTORS

RELATED APPLICATIONS

NONE.

STATEMENT REGARDING FEDERALLY SPONSORED RESEARCH

NONE.

TECHNICAL FIELD

This invention relates generally to electrical connectors and more particularly to sealing the electronics cavity of an electrical connector from the external environment.

BACKGROUND OF THE INVENTION

This section provides background information related to the present disclosure which is not necessarily prior art.

Electrical connectors are used in many environments wherein they are exposed to a variety of damaging materials that must be kept out of the electrical connectors for them to continue to function as designed. In a typical electrical connection a male portion having one or more electrical pins is plugged into a female portion to form the electrical connection. Sealing an electrical connection often refers to sealing this portion of the connection the male female interface, also known as the connector cavity. The connector seal in this portion can be unreliable or leak especially if the mating connector is unplugged or during servicing of the parts when contaminates can enter the connector cavity. Another issue in the connector cavity is that it is difficult to seal the wires of the female portion against moisture and water entering via capillary action within the wire. Another "cavity" found in an electrical connector is known in the art as an electronics cavity which is typically adjacent the connector cavity. One needs to seal this cavity also, especially in electrical connections that do not have a seal in the connector cavity. The electronics cavity is also important to seal for electrical connections wherein it is desirable to present an unsealed connector as when the connector presented has only the male portion. In the environment of vehicles preferably both the connector cavity and the electronics cavity of electrical connectors are sealed against intrusion by moisture, water, salt spray, dirt, dust, engine oils, engine transmission fluid, and other engine liquids. Many electrical connectors have been designed with physical features built in to block intrusion of outside materials into the electrical connector. Some of these connectors involve using a gasket to seal the connector; however these tend to be expensive, complicated and often take up too much space in the connector.

In addition, to the physical design of the electrical connector itself various sealants have been developed in an attempt to prevent damage to the electrical connections, components found in the connectors, and electronics cavities. The sealants used are known as form in place (FIP) sealants because they are applied to a location and can then be formed to fill gaps between parts. The sealants used include: epoxy type sealants, silicone based UV curable sealants, polyacrylic sealants and polyurethane sealants. Many factors influence the selection of the sealant including its ability to resist attack by the materials it is expected to be exposed to and the conditions under which it is expected to function. These conditions can include temperature extremes, salt exposure, exposure to corrosive fluids and other factors. In the past epoxy type sealants have been used for sealing electrical connectors of vehicles. One drawback with epoxy type sealants is that they often require a thermal cure process and/or long cure times. Low temperature such as room temperature cures do not usually produce a robust seal. Another problem with epoxy type sealants is that they may be weakened by any soldering process at the pins or terminals located in the electrical connector. Their slow cure cycle time makes them less than ideal for high-volume production lines. There is also the issue of thermal expansion of air trapped in the connector cavity when using high temperature cure of epoxy sealants. During the high temperatures the expanding trapped air escapes through the epoxy before it can cure causing bubbles and leak paths in the epoxy. Silicone based UV curable materials can be used to seal terminals without the long cure times needed for epoxy type sealants; however they are not compatible with certain engine fluids such as transmission fluids.

It is desirable to provide an electrical connector sealing method that can be used to successfully seal electrical connectors and in particular the electronic cavity of an electrical connector in a manner that can be adapted to a wide variety of connector designs, rapidly modified and that can be used in high-volume in line processes.

SUMMARY OF THE INVENTION

This section provides a general summary of the disclosure and is not intended to be interpreted as a complete and comprehensive disclosure of all it features, advantages, objectives and aspects.

In one embodiment, the present invention is a sealing insert for an electrical connector, and more particularly for an electronics cavity of an electrical connector comprising: a flared lip spaced from and extending above a base, the flared lip having a diameter that is larger than a diameter of the base; a retention feature attached to the base; and at least one electrical pin guide, the pin guide extending through the base and having an aperture sized to permit a pin of an electrical connector to pass through the base.

In another embodiment, the present invention is an electrical connector comprising: a connector housing having an inner wall, at least one electrical pin channel, and a retention feature; at least one electrical pin extending into the housing through the pin channel; a sealing insert located inside the housing and comprising a flared lip spaced from and extending above a base, the flared lip having a diameter that is larger than a diameter of the base and forming a seal against the inner wall; the sealing insert having a retention feature attached to the base and at least one pin guide, the pin guide extending through the base and having an aperture sized to permit the pin to pass through the base; the retention feature of the housing engaging the retention feature of the sealing insert thereby locking the sealing insert in the housing and forming a sealant filling gap that is in communication with the pin channel; and a sealant, the sealant located in the sealant filling gap and in the pin channel. The sealing insert and the sealant sealing the electronics cavity of the electrical connection In another embodiment, the present invention is a method of sealing an electrical connector, and more particularly the electronic cavity of an electrical connection comprising the steps of: providing an electrical connector having a housing with an inner wall, at least one electrical pin channel, a floor, a retention feature; and at least one electrical pin extending into the housing through the pin channel; providing a sealing insert comprising a flared lip spaced from and extending above a base, the flared lip having a diameter that is larger than a diameter of the base, the sealing insert having a retention feature attached to the base and at least one pin guide extending through the base and having an aperture sized to permit the pin to pass through the base; applying a sealant inside the housing of the electrical connector; and inserting the sealing insert into the housing, allowing the pin to pass through the aperture of the pin guide, and engaging the retaining feature of the housing with the retaining feature of the sealing insert thereby locking the sealing insert into the housing and forcing the sealant to flow into a sealant filling gap formed between the sealing insert and the floor of the housing and also forcing the sealant into a gap located between the pin and an inside of the pin channel. The sealant and sealing insert sealing the electronics cavity from the environment.

These and other features and advantages of this invention will become more apparent to those skilled in the art from the detailed description of a preferred embodiment. The drawings that accompany the detailed description are described below.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION OF EXEMPLARY EMBODIMENTS

The present invention provides a device and a method for sealing an electrical connector and more particularly an electronics cavity of an electrical connector. The invention can be adapted to a wide variety of electrical connectors. In the present specification and claims the term electrical connection means an electrical connection and an electronics cavity. The solution is cost effective and very efficient. The method can be adapted to use in many environments and allows for sealant selection to be customized to the particular environment of use. The present invention comprises use of a sealing insert that is placed into an electrical connector. The sealing insert provides a first layer of protection to the electronics cavity of the electrical connector to prevent entry of outside contaminants such as moisture, water, salt spray, dirt, dust, engine oil, engine fluids and other liquids. In addition, the sealing insert acts to efficiently distribute a layer of a sealant between itself and the electrical components and connector housing; the sealant thus provides a secondary sealing barrier to prevent entry by unwanted materials into the electrical connection and electronics cavity. The present invention allows for use of any liquid compatible, liquid Form In Place (FIP) sealing material to be applied to the electrical connector to form the secondary sealing layer. It also permits formation of an electrical connection that includes, for example only the male pins and yet is sealed from the outside environment. In addition, the sealing insert after installation has been found to improve positional accuracy of the pins in the electrical connector especially when long flexible pins are used.

Figure 1:
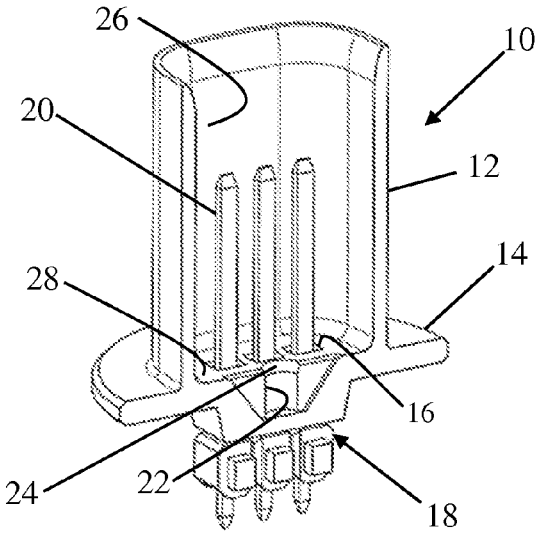
FIG. 1 is a cross-sectional view of an electrical connector designed according to the present invention.

FIG. 1 is a cross-sectional view of an electrical connector designed according to the present invention. The electrical connector is shown generally at 10. The connector 10 includes a housing 12 and a base 14. The base 14 includes a plurality of pin channels 16 that extend through the base 14 and receive a plurality of pins 20. The pins 20 extend out of a connector terminal header 18. The base 14 further includes a compression pin hole 22 that preferably has a chamfered portion 24 at one end. The housing 12 includes an inner wall 26 and a housing floor 28. The shown electrical connector is the male end of a typical electrical connector.

Figure 2:
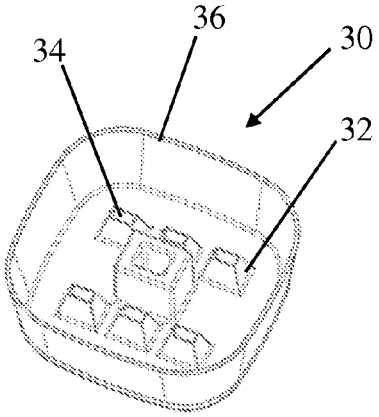
FIG. 2 is a top perspective view of a sealing insert designed according to the present invention.
Figure 3:
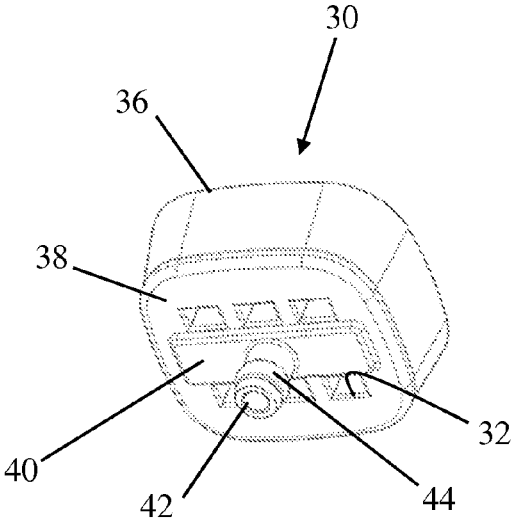
FIG. 3 is a bottom perspective view of the sealing insert shown in FIG. 2.

FIG. 2 is a top perspective view of a sealing insert designed in accordance with the present invention. The sealing insert is shown generally at 30. The sealing insert 30 includes a plurality of pin guides 32 each of which has an aperture 34 to allow a pin 20 to be inserted through pin guide 32. The size and shape of the apertures 34 are chosen to be approximately the same size and shape as the outside of the pins 20 or slightly smaller. This permits the aperture 34 to form a seal around the pin 20 as the pin 20 is inserted through the pin guide 32. The sealing insert 30 further includes a flared lip 36 having a shape that mirrors the shape of the inner wall 26 of the housing 12. The diameter of the flared lip 36 is the same or slightly larger than the diameter of the inner wall 26 so that when the sealing insert 30 is positioned in the housing 12 the flared lip 36 will press tightly against the inner wall 26 and form a seal between the sealing insert 30 and the inner wall 26 of the housing 12. The combination of the seal around the pins 20 from the apertures 34 and the seal of the flared lip 36 against the inner wall 26 of the housing 12 forms a first sealing layer of the sealing insert 30. FIG. 3 is a bottom perspective view of the sealing insert 30 of FIG. 2. The sealing insert 30 further includes a base 38. Located on the base 38 is a hard stop 40 from which protrudes a compression pin 42 having a raised compression fit band 44 on it.

Figure 4:
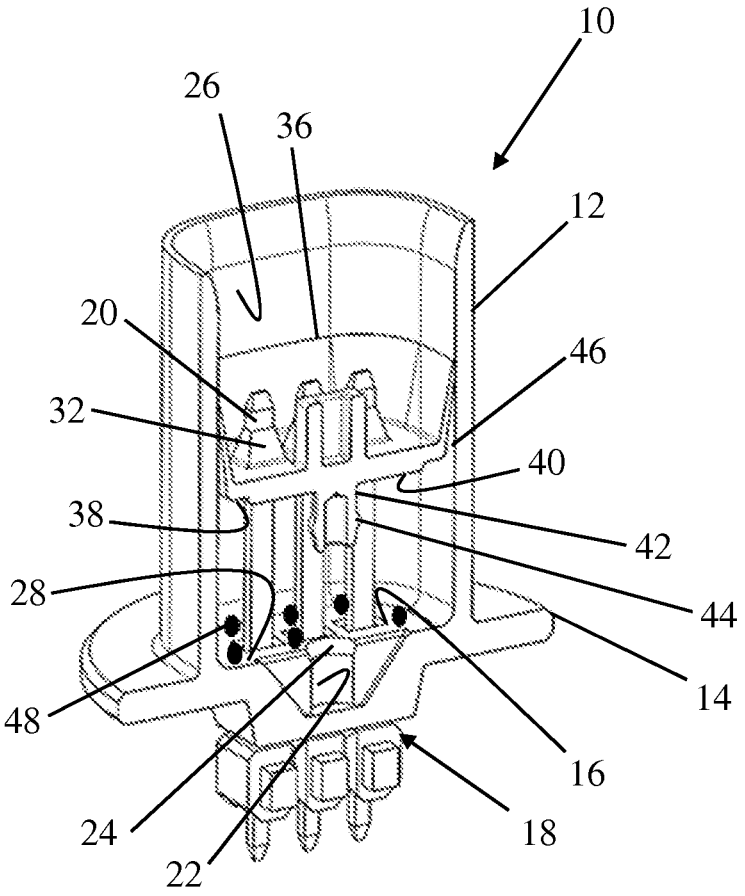
FIG. 4 is a cross-sectional view of the sealing insert of FIG. 2 being inserted into the electrical connector of FIG. 1.

FIG. 4 shows the sealing insert 30 partially inserted into the housing 12. In use of the present invention a selected sealant, shown at 48 as beads, is first applied to the floor 28 prior to insertion of the sealing insert 30. The sealant 48 can be applied as a plurality of spots or beads around the floor 28 or as a continuous bead on the floor 28 or in any desired pattern. As discussed herein the sealant 48 can be one of many available with the sealant chosen based on a number of criteria. The sealants are FIP sealants and one that is preferred for use in one embodiment of the present invention is a polyacrylic sealant, Loctite® 5810, which is resistant to a wide variety of engine fluids including transmission fluid. As discussed herein, prior to insertion of the sealing insert 30 the FIP sealant 48 is applied inside the housing 12 at a plurality of locations on the floor 28 and around pin channels 16. As can be seen as the sealing insert 30 is inserted into the housing 12 the flared lip 36 forms a tight seal against the inner wall 26 of the housing 12. The sealing insert 30 is formed from a resilient material, preferably a plastic material or elastomeric material, that is elastic in nature and that can be deformed but returns to its original shape. One can see that there is a gap 46 between the base 38 of the sealing insert 30 and the inner wall 26 of the housing 12. This gap will fill with the sealant 48 once the sealing insert 30 is fully inserted into the housing 12. The compression pin 42 aligns with the compression pin hole 22 and the raised compression fit band 44 forms a press-fit against the walls of the compression pin hole 22 to lock the sealing insert 30 into the housing 12. As the sealing insert 30 is inserted into the housing 12 the pin guides 32 help to further align and stabilize the positions of the pins 20 in the housing 12.

Figure 5:
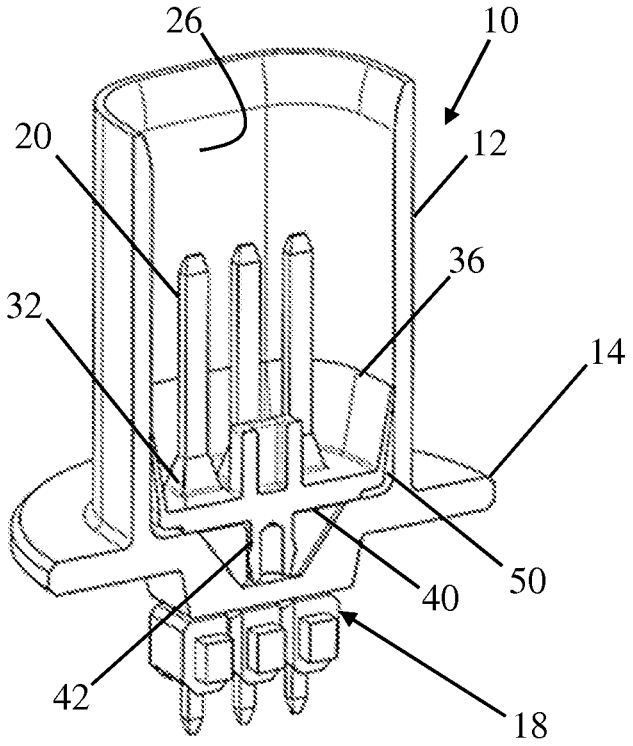
FIG. 5 is a cross-sectional view of the sealing insert of FIG. 2 after being fully inserted into the electrical connector of FIG. 1.
Figure 6:
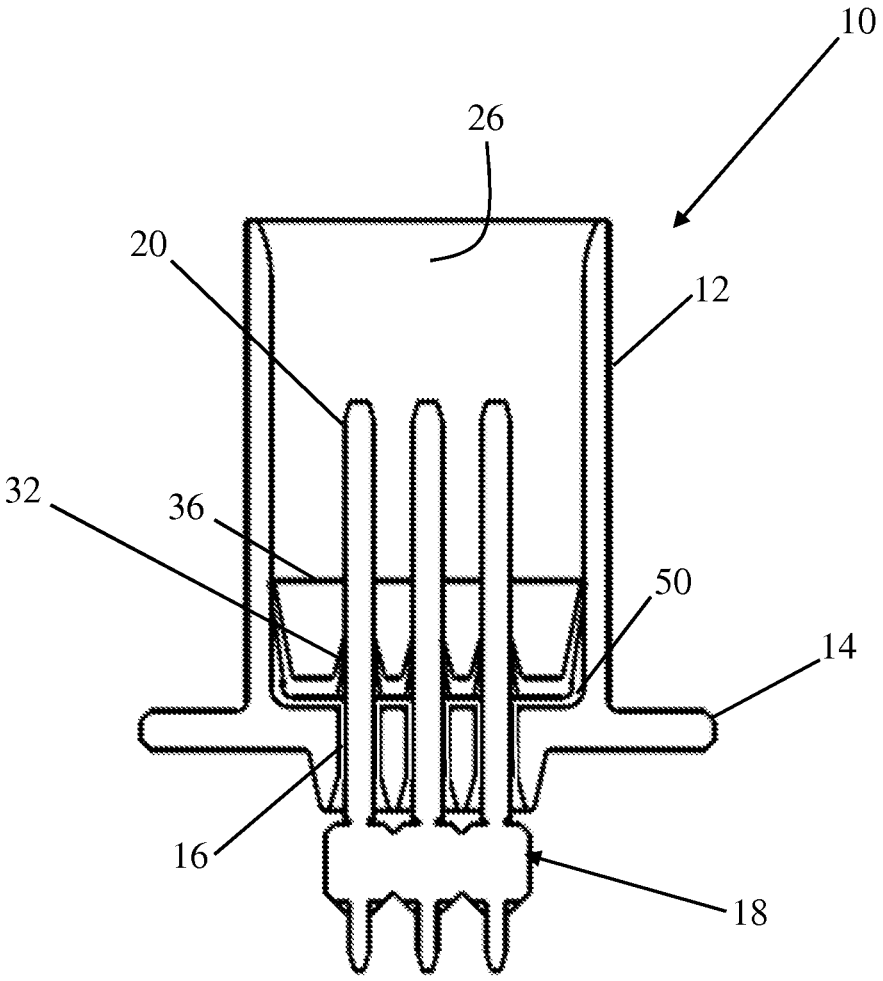
FIG. 6 is a different cross-sectional view of the sealing insert of FIG. 2 fully inserted into the electrical connector of FIG. 1.

FIG. 5 shows the sealing insert 30 fully received in the housing 12. For clarity and to help with the description the dispersed sealant 48 is not shown in this Figure. As shown, the compression pin 42 is fully received in the compression pin hole 22 and serves to lock the sealing insert 30 into the housing 12. The flared lip 36 forms a tight seal against the inner wall 26 of the housing 12. The hard stop 40 provides for a sealant fill gap 50 around and underneath the base 38, except for where the hard stop 40 is located, of the sealing insert 30. This gap 50 fills with sealant 48 when the sealing insert 30 is fully inserted. The insertion of the sealing insert 30 also causes the sealant 48 to rise up the sides of the sealing insert 30 and to fill the pin guides 32 in the area not occupied by the pin 20. As can be seen the aperture 34 of the pin guide 32 forms a tight seal around the pin 20 where the pin 20 emerges from the aperture 34. The aperture 34 fits tightly around the pin 20 and does not permit sealant 48 to exit through the aperture 34. The pin guides 32 help to stabilize the pins 20 and maintain their position. The sealing insert 30 acts as a plunger and distributes the sealant 48 throughout the entire sealant fill gap 50, around the sealing insert 30 until stopped by the seal between the flared lip 36 and the inner wall 26, and down the pin channels 16. The sealant 48 emerges out of the bottom of the pin channels 16. The sealant fill gap 50 is preferably 1 millimeter to 0.5 millimeters thick between the floor 28 and the base 38 when the sealing insert 30 is fully inserted. The thickness of the hard stop 40 and the difference in diameter between the diameter of the inner wall 26 and the base 38 will determine the thickness of the sealant fill gap 50 and can be adjusted as desired for any particular environment. The sealant 48 will also flow up the pin guides 32 until stopped by the apertures 34 and up the sides of the sealing insert 30 until stopped by the meeting of the flared lip 36 with the inner wall 26. Preferably sealant fill gap 50 is completely filled and the excess sealant 48 flows down and out the pin channels 16 in the connector 10 adjacent the terminal header 18. Thus, the sealant 48 and the sealing insert 30 completely seal the electronics cavity from the external environment. The electrical connector 10 shown in FIG. 5 has a completely sealed electronics cavity while still providing ready access to the pins 20 to permit connection of a female connector to form a completed electrical connection. FIG. 6 is a cross-sectional view of the connector 10 of FIG. 1 with the sealing insert 30 fully inserted at a different cross-sectional location from the cross-section shown in FIG. 5. One can see in FIG. 6 that the sealant fill gap 50 is in communication with the pin channels 16 when the sealing insert 30 is fully inserted. The sealant, not shown for clarity, will be forced by the sealing insert 30 to fill the sealant fill gap 50 and flow out the pin channels 16 through the small gap between the pin 20 and the walls of its respective pin channel 16. Preferably the amount of sealant 48 used is sufficient to drive excess sealant 48 out of the pin channels 16 and form a small bead around a pin 20 at the junction between the end of the pin channel 16 and the terminal header 18. These small beads completely seal the electrical connector 10 and also serve as vibrational dampening attenuators when the terminal header 18 is plugged into a printed circuit board for example.

Figure 7:
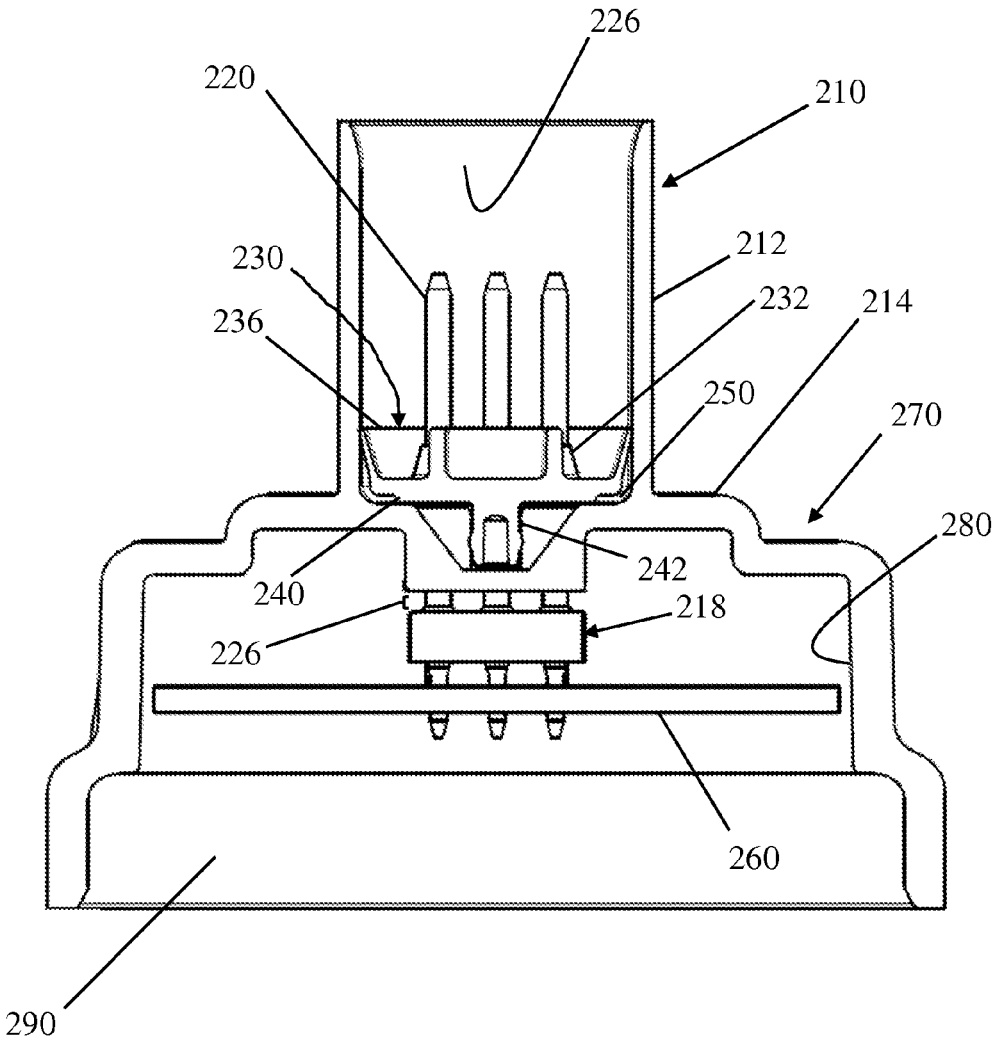
FIG. 7 is a cross-sectional view of another electrical connector integrated into an electronic controller with the sealing insert shown in FIG. 2.

FIG. 7 shows a cross-sectional view of another electrical connector according to the present invention. The electrical connector is shown generally at 210 and it includes a housing 212, an inner wall 226 and a base 214. In this embodiment the base 214 is integrated into an electronic controller shown generally at 270 which is mounted to a housing 290. The connector 210 further includes a plurality of pins 220 and includes a sealing insert 230 just like the one shown in FIGS. 2-6. The sealing insert 230 includes pin guides 232, a compression pin 242, a hard stop 240, and a flared lip 236 as described herein. The insertion of the sealing insert 230 into the housing 212 forms the sealant fill gap 250 as discussed above. As shown in FIG. 7 the electrical connector 210 is integrated with an electronics cavity 280 and the terminal header 218 is received in a printed circuit board 260 in the electronics cavity 280. Also shown is a terminal header gap 226 which as described herein preferably accommodates a sealant bead when the sealing insert 230 is fully received in the connector 210 and sealant is pushed out the pin channels 16. As shown, once the sealant, not shown, has been distributed throughout the sealant fill gap 250, up the pin guides 232 and down the pin channels, which are not shown in this cross-sectional view, the electronics cavity 280 is sealed from the outside environment. This is true even if the male pins 220 are not connected to a female connector.

In the embodiments shown in FIGS. 1-7 the sealing insert has a retention feature comprising a compression pin 42 having a raised compression fit band 44 on it. In the embodiments shown in FIGS. 1-7 the electrical connector 10 has a retention feature comprising a compression pin hole 22 which receives the compression pin 42 and together they lock the sealing insert 30 in the housing 12 of the electrical connector 10. The flared lip 36 and apertures 34 in the pin guides 32 serve as a secondary retention feature on the sealing insert 30 by their friction fit seal against the inner wall 26 of the electrical connector 10 and the pins 20, respectively. They also serve as a secondary seal in the sealing insert 30. Finally, the sealant 48 itself serves as an adhesive to hold the sealing insert 30 in place in the electrical connector 10.

Figure 8:
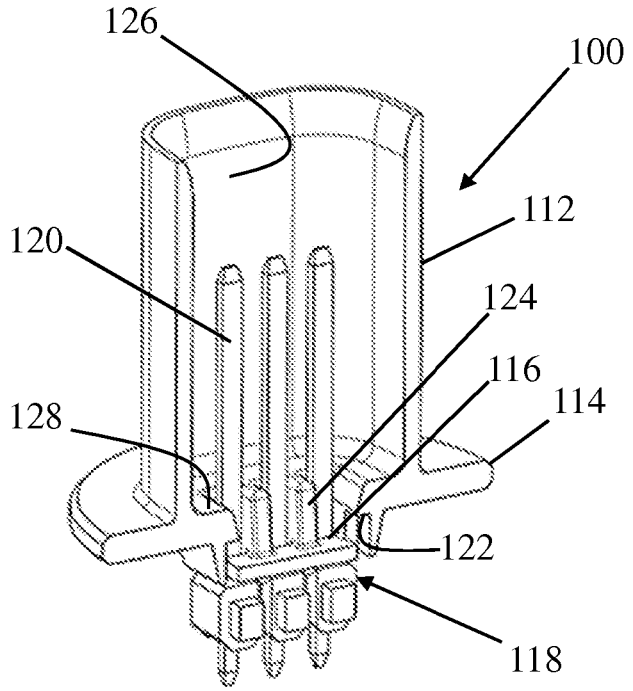
FIG. 8 is a cross-sectional view of an electrical connector designed according to the present invention.

FIG. 8 is a cross-sectional view of an electrical connector designed according to the present invention. The electrical connector is shown generally at 100. The connector 100 includes a housing 112 and a base 114. The base 114 includes a plurality of pin channels 116 that extend through the base 114 and receive a plurality of pins 120. The pins 120 extend out of a connector terminal header 118. The base 114 further includes a plurality of support posts 124 located between several of the pins 120. The housing 112 includes an interior wall 126, a housing floor 128 and a pair of snap fit lips 122 located opposite each other.

Figure 9:
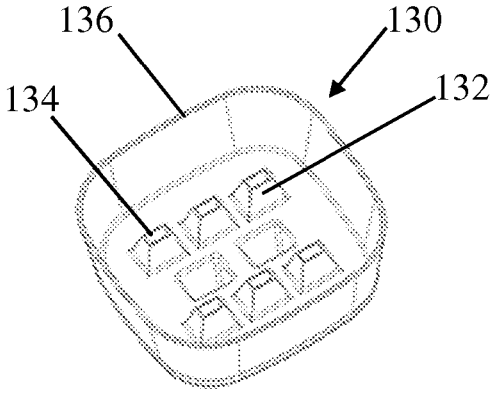
FIG. 9 is a top perspective view of a sealing insert designed according to the present invention.
Figure 10:
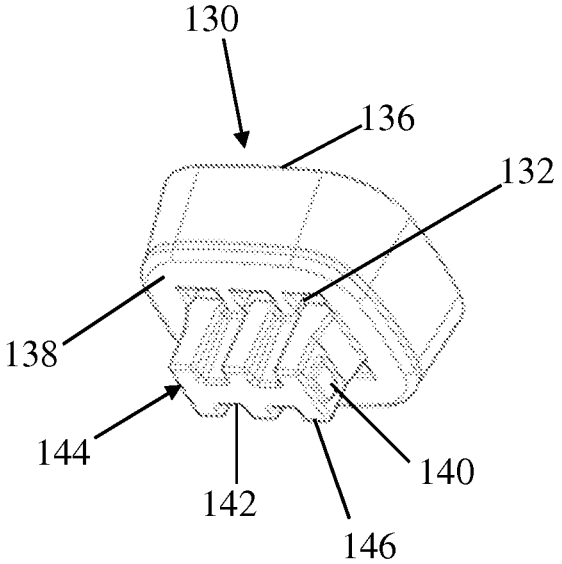
FIG. 10 is a bottom perspective view of the sealing insert shown in FIG. 9.

FIG. 9 is a top perspective view of a sealing insert designed in accordance with the present invention. The sealing insert is shown generally at 130. The sealing insert 130 includes a plurality of pin guides 132 each of which has an aperture 134 to allow a pin 120 to be inserted through pin guide 132. The size and shape of the apertures 134 are chosen to be approximately the same size and shape as the outside of the pin 120 or slightly smaller. This permits the aperture 134 to form a seal around the pin 120 as the pin 120 is inserted through the pin guide 132. The sealing insert 130 further includes a flared lip 136 having a shape that mirrors the shape of the inner wall 126 of the housing 112. The diameter of the flared lip 136 is the same or slightly larger than the diameter of the inner wall 126 so that when the sealing insert 130 is positioned in the housing 112 the flared lip 136 will press tightly against the inner wall 126 and form a seal between the sealing insert 130 and the inner wall 126 of the housing 112. The combination of the seal around the pins 120 from the apertures 134 and the seal of the flared lip 136 against the inner wall 126 of the housing 112 forms a first sealing layer of the sealing insert 130. FIG. 10 is a bottom perspective view of the sealing insert 130 of FIG. 9. The sealing insert 130 further includes a base 138. Located on the base 138 is a retention feature comprising a support 144 that includes a plurality of slots 142, a plurality of pillars 146, and a pair of snap fit protrusions 140, only one of which is shown in this view, on opposite sides of the support 144.

Figure 11:
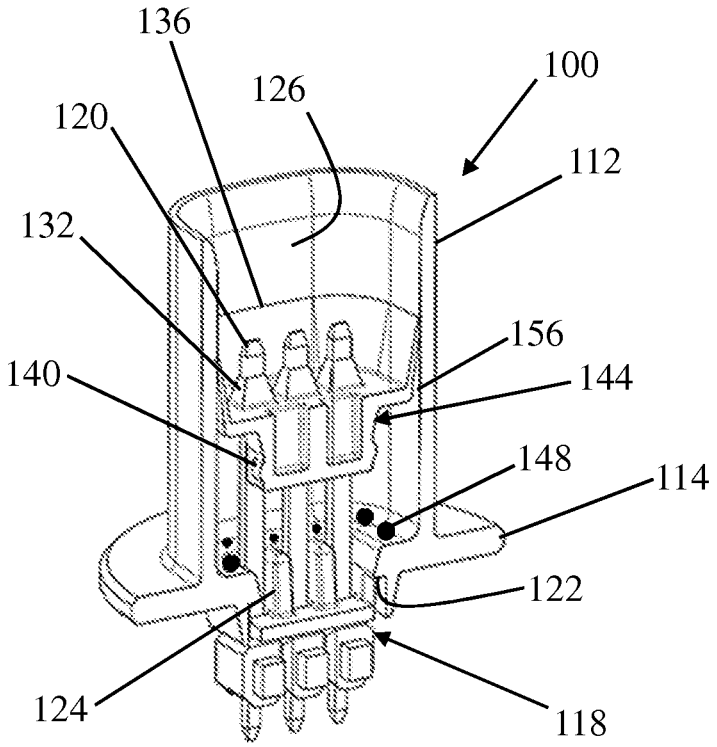
FIG. 11 is a cross-sectional view of the sealing insert of FIG. 9 being inserted into the electrical connector of FIG. 8.

FIG. 11 shows the sealing insert 130 partially inserted into the housing 112. In use of the present invention a selected sealant, shown at 148 as beads, is first applied to the floor 128 prior to insertion of the sealing insert 130. The sealant 148 can be applied as a plurality of spots or beads around the floor 128 or as a continuous bead on the floor 128 or in any desired pattern. As discussed herein the sealant 148 can be one of many available with the sealant chosen based on a number of criteria. The sealants are FIP sealants and one that is preferred for use in one embodiment of the present invention is a polyacrylic sealant, Loctite® 5810, which is resistant to a wide variety of engine fluids including transmission fluid. As discussed, prior to insertion of the sealing insert 130 the FIP sealant 148 is applied inside the housing 112 at a plurality of locations on the floor 128 and around pin channels 116. As can be seen as the sealing insert 130 is inserted into the housing 112 the flared lip 136 forms a tight seal against the inner wall 126 of the housing 112. The sealing insert 130 is formed from a resilient material, preferably a plastic material or elastomeric material, that is elastic in nature and that can be deformed but returns to its original shape. One can see that there is a gap 156 between the base 138 of the sealing insert 130 and the inner wall 126 of the housing 112. This gap will fill with the sealant 148 once the sealing insert 130 is fully inserted into the housing 112. The snap fit protrusions 140 align with the snap fit lips 122 and once the protrusions 140 are pushed past the lips 122 the sealing insert 130 is locked into the housing 112.

Figure 12:
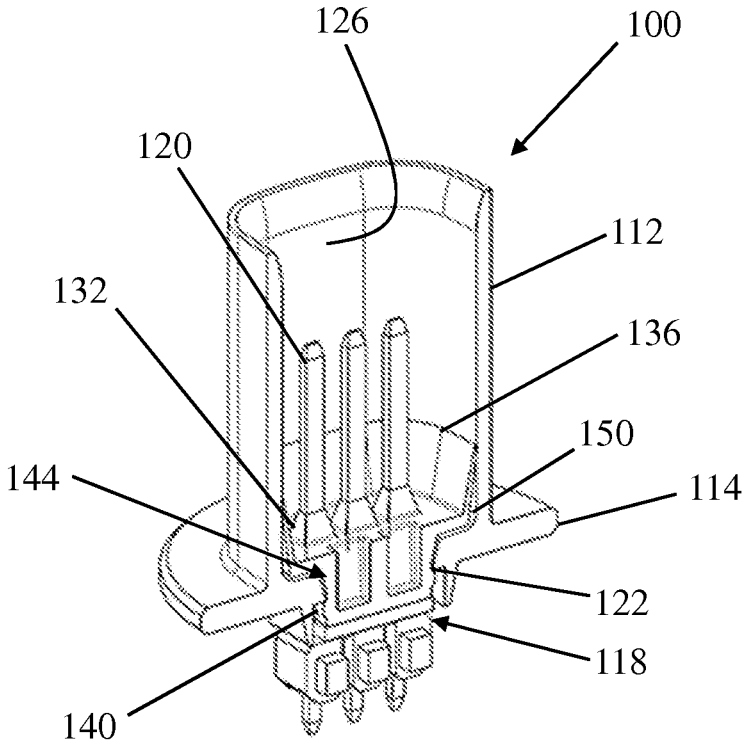
FIG. 12 is a is a cross-sectional view of the sealing insert of FIG. 9 after being fully inserted into the electrical connector of FIG. 8.
Figure 13:
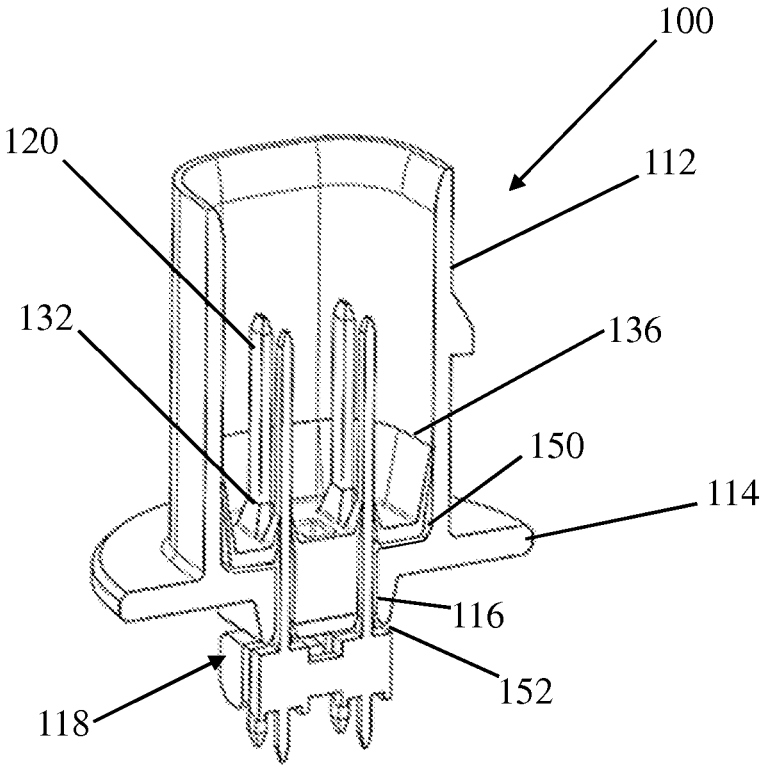
FIG. 13 is a different cross-sectional view of the sealing insert of FIG. 9 fully inserted into the electrical connector of FIG. 8.

FIG. 12 shows the sealing insert 130 fully received in the housing 112. For clarity and to help with the description the sealant 148 is not shown in this Figure. As shown the snap fit protrusions 140 are fully under the snap fit lips 122, which serves to lock the sealing insert 130 into the housing 112. The flared lip 136 forms a tight seal against the inner wall 126 of the housing. The length of the support 144 is chosen so that when fully seated the sealing insert 130 provides for a sealant fill gap 150 around the base 138 of the sealing insert 130. This gap 150 fills with sealant 148 when the sealing insert 130 is fully inserted. The insertion of the sealing insert 130 also causes the sealant 148 to fill the pin guides 132 in the area not occupied by the pin 120. As can be seen the aperture 134 of the pin guide 132 forms a tight seal around the pin 120 where the pin 120 emerges from the aperture 134. The aperture 134 fits tightly around the pin 120 and does not permit sealant 148 to exit through the aperture 134. The sealing insert 130 acts as a plunger and distributes the sealant 148 throughout the entire sealant fill gap 150 between the base 138 and the floor 128 and down the pin channels 116 in the connector 100. The sealant 148 emerges out of the bottom of the pin channels 116. The sealant fill gap 150 is preferably approximately 1 millimeter to 0.5 millimeters thick between the floor 128 and the base 138 when the sealing insert 130 is fully inserted. The length of the support 144 and the difference in diameter between the diameter of the inner wall 126 and the base 138 will determine the thickness of the sealant fill gap 150 and can be adjusted as desired for any particular environment. The sealant 148 will also flow up the pin guides 132 until stopped by the apertures 134 and up the sides of the sealing insert 130 until stopped by the meeting of the flared lip 136 with the inner wall 126. Preferably sealant fill gap 150 is completely filled and the excess sealant 148 flows down and out the pin channels 116 in the connector 100 adjacent the terminal header 118. FIG. 13 is a cross-sectional view of the connector 100 of FIG. 8 with the sealing insert 130 fully inserted at a different cross-sectional location from the cross-section shown in FIG. 12. One can see in FIG. 13 that the sealant fill gap 150 is in communication with the pin channels 116 when the sealing insert 130 is fully inserted. The sealant, not shown for clarity, will be forced by the sealing insert 130 to fill the sealant fill gap 150 and flow out the pin channels 116 through the small gap between the pin 120 and the walls of its respective pin channel 116. Preferably the amount of sealant 148 used is sufficient to drive excess sealant 148 out of the pin channels 116 and form a small bead around a pin 120 at the junction between the end of the pin channel 116 and the terminal header 118 at a terminal header gap 152. These small beads help seal the connector 100 and also serve as vibrational dampening attenuators when the terminal header 118 is plugged into a printer circuit board for example.

Figure 14:
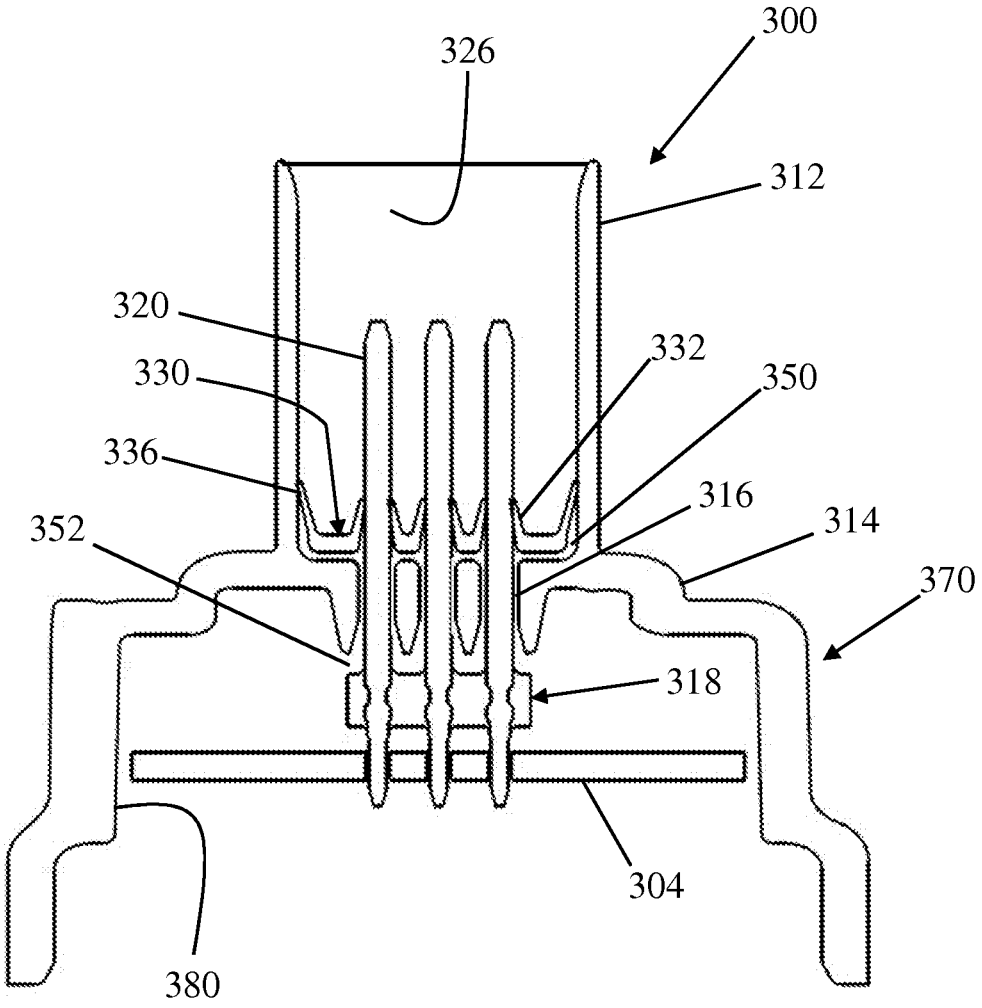
FIG. 14 is a cross-sectional view of another electrical connector integrated into an electronic controller with the sealing insert shown in FIG. 9.
Figure 15:
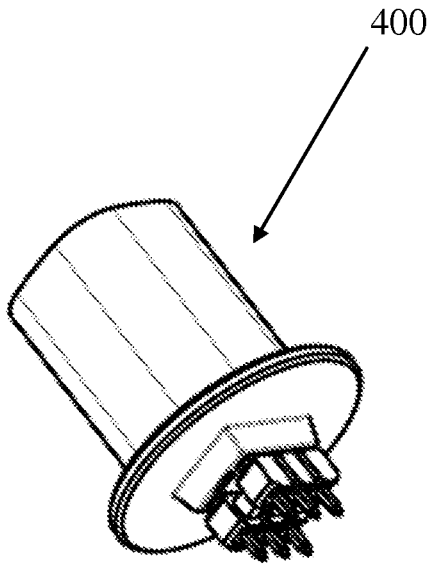
FIG. 15 is a perspective view of an assembled electrical connector according to the present invention.

FIG. 14 shows a cross-sectional view of another electrical connector according to the present invention. The electrical connector is shown generally at 300 and it includes a housing 312, an inner wall 326, pin channels 316 and a base 314. In this embodiment the base 314 is integrated into an electronic controller shown generally at 370 and which includes an electronics cavity 380. The connector 300 further includes a plurality of pins 320 and includes a sealing insert 330 just like the one shown in FIGS. 9-10. The sealing insert 330 includes a support, not shown, pin guides 332 and a flared lip 336 as described herein. The insertion of the sealing insert 330 into the housing 312 forms the sealant fill gap 350 as discussed above. As shown in FIG. 14 the terminal header 318 is received in a printed circuit board 304 and both are located in the electronics cavity 380. Also shown is a terminal header gap 352 which as described herein preferably accommodates a sealant bead when the sealing insert 330 is fully received in the connector 300 and sealant is pushed out the pin channels 316. Once the sealant has fully filled the sealant gap 350, flowed up the pin guides 332 and down the pin channels 316 the electronics cavity 380 is completely sealed from the outside environment. Not shown is that similar to FIG. 7 the electronic controller 370 will be mounted to a housing and thus seal the other end of the electronics cavity 380. FIG. 15 shows a perspective view of a fully assembled electrical connector generally at 400 that represents an electrical connector as shown in FIGS. 1, 4-8, and 11-13.

In the embodiments shown in FIGS. 8-14 the sealing insert 130 has a retention feature comprising a support 138 that includes a plurality of pillars 146, slots 142 and snap fit protrusions 140. In the embodiments shown in FIGS. 8-14 the electrical connector 100 has a retention feature comprising a plurality of supports posts 124 that are received in the slots 142 of the support 138 on the sealing insert 130 and snap fit lips 122 that the snap fit protrusions 140 fit under and together these retention features lock the sealing insert 130 in the housing 112 of the electrical connector 100. The flared lip 136 and apertures 134 in the pin guides 132 serve as a secondary retention feature on the sealing insert 130 by their friction fit seal against the inner wall 126 of the electrical connector 100 and the pins 120, respectively. They also serve as a secondary seal in the sealing insert 130. Finally, the sealant 148 itself serves as an adhesive to hold the sealing insert 130 in place in the electrical connector 100.

As discussed herein the sealing insert according to the present invention is preferably formed from a resilient material that is capable of being deformed and then returning to its original shape. Preferably the sealing insert is formed from a plastic material or an elastomeric material. The composition of the plastic or elastomer is selected based on the environment the sealing insert is expected to encounter in use. Thus, it may be designed to resist water, salt spray, corrosive liquids, engine oils, engine fluids, transmission fluids, dust, dirt, extremes of temperature, and cycling between temperature extremes. One of skill in the art will be able to select a plastic composition or elastomeric composition capable of resisting these environments. The sealing insert can be formed from raw sheet stock or block stock. The sealing insert is preferably formed by injection molding; however other manufacturing processes can be utilized including molding, use of sheet molding compounds, extrusion, hot forming and cold forming, vacuum forming, stamping and machining. Preferably the sealing insert is designed to allow for a sealant sealing layer of approximately 1 millimeter to 0.5 millimeters between the sealing insert and the floor of the electrical connector; however this distance can be varied by the requirements of the environment and the characteristics of the sealant used. An optimum thickness is usually defined by the cure characteristics and performance requirements. As discussed herein the choice of sealant is determined by the expected environment and one of skill in the art will be able to select an appropriate sealant. The sealing insert can be adapted to fit inside any electrical connector housing provided it contains the appropriate retention feature to mate with the retention feature located on the sealing insert as shown herein. In other embodiments the sealing insert could include more than one retention feature as described provided the electrical connector includes a similar number of mating retention features as described. The number of pin guides in the sealing insert can also be modified to accommodate the number of pins in the electrical connector. The pins have been shown as arranged in two rows of three pins; however this is for illustrative purposes only and the number and arrangement of pins in the electrical connector can be varied with a corresponding variation in the number and location of pin guides in the sealing insert.

In the method of use of the present invention in a first step a suitable sealant is applied inside the housing of the electrical connector generally at a plurality of locations on the floor and around the pins. Next the sealing insert is inserted into the housing and pressed down until the retention features on the sealing insert engage with mating retention features in the housing of the electrical connector as described. The sealant is forced by the sealant insert to fill the sealant fill gap and to flow out of a bottom the pin channels opposite the apertures found in the pin guides of the sealing insert. The sealant is allowed to cure for the required time and the electrical connector is then sealed from the environment. In experiments of leak testing electrical connectors and sealing insets according to the embodiments shown in the Figures were tested as follows. A sealant, Loctite® 5810, was applied inside the electrical connector housing as described and then the sealing inserts were fully inserted and the retention features were engaged to lock the sealing inserts in place and to distribute the sealant into the sealant fill gap. The assembled electrical connectors with sealant and sealing inserts were allowed to cure for 24 hours. Then they were leak tested by subjecting them to a pressure of 6.2 bar of internal pressure in the sealed electronics cavity in a tank of water. There were no bubbles observed in the water tank which indicates there was no leakage of air from inside the sealed electronics cavity sealed as described in the present invention. In other testing the connectors sealed as described herein were subjected to both thermal cycling and application of vibration while the sealed area was exposed to the fluid of the environment they were expected to be exposed to. The fluid included an fluorescent dye and after the selected testing duration the interior of the sealed area was opened and examined for traces of the fluorescent dye. No dye was found inside the previously sealed cavity indicating that no leakage had occurred.

The sealants that can be used in the present invention are many and the preferred sealant depends on the likely environment that the electrical connector will be exposed to. Suitable sealants can include: epoxy type sealants, either two part fast cure epoxies which tend to have poorer chemical resistance or one part high performance fast cure epoxies that require a high temperature cure; UV curable silicone based sealants; polyacrylic sealants; polyurethane sealants; and others known in the art. The sealant must be chosen based on its ability to seal the pins of the electrical connector against entry by substances such as water, moisture, salt spray, engine oils and transmission fluids to name a few. The sealant must maintain its adhesion to the electrical connector housing and the sealing insert of the present invention. In the specific environment of a transmission of a vehicle the sealant preferably is not a silicone based sealant since such sealants are not able to withstand the effects of transmission fluids. Preferably, the sealant will be able to cure in a rapid enough time frame to allow for in line production of the sealed electrical connector. One drawback of epoxy based sealants is their tendency to require long cure times. In the environment of a transmission of vehicle a preferred sealant is a polyacrylic type sealant such as Loctite® 5810. In other environments other sealants will find use as known to those of skill in the art.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

I claim:

1. A sealing insert for an electrical connector comprising:

a flared lip spaced from and extending above a base, said flared lip having a diameter that is larger than a diameter of said base;

at least one electrical pin guide extending through said base and having an aperture sized to permit a pin of an electrical connector to pass through said base; and a support extending from said base and including at least one snap fit protrusion.

2. A sealing insert as recited in claim 1, wherein said support further comprises at least one pillar and at least one slot and wherein said at least one snap fit protrusion is located on said at least one pillar.

3. An electrical connector comprising:

a connector housing having an inner wall, at least one electrical pin channel, and a housing retention feature;

at least one electrical pin extending into said housing through said pin channel;

a sealing insert located inside said housing and comprising a flared lip spaced from and extending above an insert base, said flared lip having a diameter that is larger than a diameter of said insert base and forming a seal against said inner wall;

said sealing insert having an insert retention feature attached to said insert base and at least one pin guide, said pin guide extending through said insert base and having an aperture sized to permit said pin to pass through said insert base;

said housing retention feature engaging said insert retention feature thereby locking said sealing insert in said housing and forming a sealant filling gap that is in communication with said pin channel; and a sealant located in said sealant filling gap and in said pin channel.

4. An electrical connector as recited in claim 3, wherein said aperture in said pin guide forms a seal around said pin.

5. An electrical connector as recited in claim 3, wherein said housing retention feature comprises a compression pin hole and said insert retention feature comprises a compression pin extending from said insert base and that is received in said compression pin hole thereby locking said sealing insert in said housing.

6. An electrical connector as recited in claim 5, wherein said sealing insert further comprises a hard stop located on said insert base.

7. An electrical connector as recited in claim 5, wherein said compression pin further comprises a raised compression fit band encircling said compression pin.

8. An electrical connector as recited in claim 3, wherein said housing retention feature comprises at least one snap fit lip and said insert retention feature comprises at least one snap fit protrusion that fits under said snap fit lip thereby locking said sealing insert in said housing.

9. An electrical connector as recited in claim 8, wherein said insert retention feature further comprises a support extending from said insert base and said snap fit protrusion is located on said support.

10. An electrical connector as recited in claim 9, wherein said housing further includes at least one support post and said support of said sealing insert includes at least one slot with said support post received in said slot when said sealing insert is locked in said housing by said retention features.

11. A method of sealing an electrical connector comprising the steps of:

a) providing an electrical connector having a housing with an inner wall, at least one electrical pin channel, a floor, a housing retention feature; and at least one electrical pin extending into the housing through the pin channel;

b) providing a sealing insert comprising a flared lip spaced from and extending above an insert base, the flared lip having a diameter that is larger than a diameter of the insert base, the sealing insert having an insert retention feature attached to the insert base and at least one pin guide extending through the insert base and having an aperture sized to permit the pin to pass through the insert base;

c) applying a sealant inside the housing of the electrical connector; and d) inserting the sealing insert into the housing, allowing the pin to pass through the aperture of the pin guide, and engaging the housing retaining feature with the insert retaining feature thereby locking the sealing insert into the housing and forcing the sealant to flow into a sealant filling gap formed between the sealing insert and the floor of the housing and also forcing the sealant into a gap located between the pin and an inside of the pin channel.

12. The method as recited in claim 11, further comprising in step d) forming a seal between the flared lip and the inner wall.

13. The method as recited in claim 11 further comprising in step d) forming a seal between the pin and the aperture of the pin guide.

14. The method as recited in claim 11, wherein step a) further comprises providing a housing retention feature comprising at least one snap fit lip; step b) further comprises providing an insert retaining feature comprising at least one snap fit protrusion; and step d) further comprises receiving the snap fit protrusion under the snap fit lip thereby locking the sealing insert into the housing.

15. The method as recited in claim 11, wherein step c) comprises applying a polyacrylic sealant.

16. The method as recited in claim 11, wherein step a) further comprises providing a housing retention feature comprising a compression pin hole; step b) further comprises providing an insert retaining feature comprising a compression pin; and step d) further comprises receiving the compression pin in the compression pin hole thereby locking the sealing insert into the housing.

17. The method as recited in claim 16, wherein step b) further comprises providing a sealing insert having a hard stop located on the insert base and wherein the hard stop functions to define a part of the sealant filling gap in step d).

* * * * *